United States Patent [19]

Grenn

[11] 4,014,626

[45] Mar. 29, 1977

[54] CENTRIFUGAL PUMP MEANS

[76] Inventor: James F. Grenn, Rte. 2, Bogue Chitto, Miss. 39629

[22] Filed: Sept. 8, 1975

[21] Appl. No.: 611,427

[52] U.S. Cl. ..... 415/102; 415/109

[51] Int. Cl.[2] ..... F04D 17/00

[58] Field of Search ..... 415/102, 109

[56] References Cited

UNITED STATES PATENTS

| | | | |
|---|---|---|---|
| 1,310,680 | 7/1919 | Sherbondy | 415/102 |
| 1,949,429 | 3/1934 | McGee | 415/109 |
| 2,127,865 | 8/1938 | Goddard | 415/109 |
| 2,390,504 | 12/1945 | Berger | 415/109 |
| 3,146,722 | 9/1964 | Warman | 415/109 |
| 3,176,621 | 4/1965 | Phillips | 415/102 |

FOREIGN PATENTS OR APPLICATIONS

| | | | |
|---|---|---|---|
| 29,524 | 10/1907 | Austria | 415/109 |

*Primary Examiner*—Henry F. Raduaz
*Attorney, Agent, or Firm*—John R. Walker, III

[57] ABSTRACT

A centrifugal pump having a rotatably driven impeller for drawing liquid into the center of a pump housing through an inlet port and for forcing the liquid to the periphery of the pump housing and out an outlet port. The centrifugal pump is adapted to prevent the liquid that has been forced to the periphery of the pump housing from "short circuiting" back to the center of the pump housing.

1 Claim, 3 Drawing Figures

CENTRIFUGAL PUMP MEANS

BACKGROUND OF THE INVENTION

1. Field of the Invention:

This invention relates to centrifugal means for pumping liquids.

2. Description of the Prior Art

Heretofore, various centrifugal pump means have been developed. See, for example, La Bour, U.S. Pat. No. 2,381,823; Egger, U.S. Pat. No. 3,171,357; Vilet, U.S. Pat. No. 3,395,645; and Fabri et al, U.S. Pat. No. 3,824,029. None of the above patents disclose or suggest the present invention.

All the prior centrifugal pump means known to applicant have not performed entirely satisfactorily because of the problem of "short circuiting" of the liquid being pumped. That is, before the present invention, the liquid being pumped by the prior centrifugal pump means tended to "short circuit" or recirculate back through the impeller after being forced to the periphery of the pump housing by the impeller thereby cutting down on the efficiency of the centrifugal pump means.

SUMMARY OF THE INVENTION

The present invention is directed towards overcoming the problems and disadvantages of prior centrifugal pump means. The centrifugal pump means of the present invention includes, in general, a housing means, an impeller means, a drive means and a seal means. The housing means includes a hollow interior, a centrally located inlet means for allowing liquid to enter the interior, and a peripherally located outlet means for allowing liquid to exit the housing means. The impeller means is rotatably positioned within the interior of the housing means for selectively drawing liquid into the interior of the housing means through the inlet means thereof and forcing liquid to the periphery of the interior of the housing means and out the outlet means thereof. The seal means is adapted to prevent the liquid being forced to the periphery of the interior of the housing means by the impeller means from passing back to the center of the housing means.

DESCRIPTION OF THE PREFERRED EMBODIMENT

Figure 1:
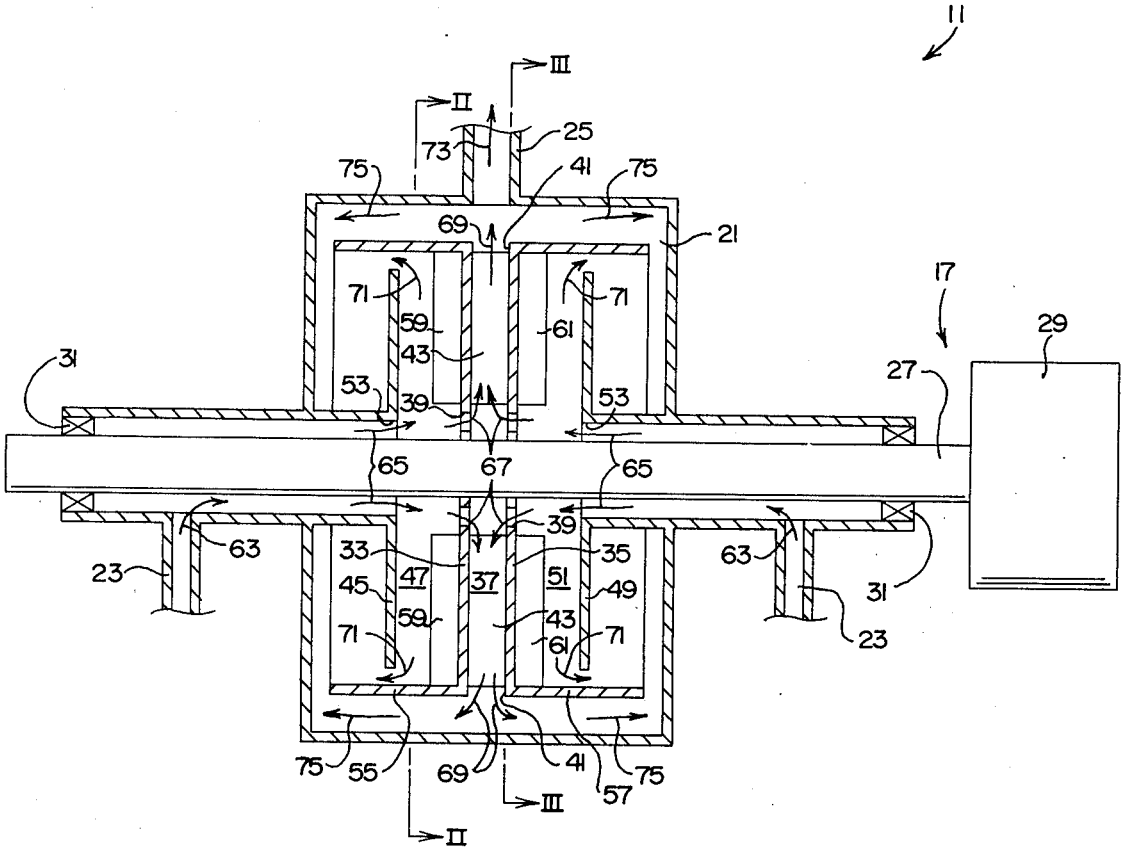
FIG. 1 is a longitudinal sectional view of the centrifugal pump means of the present invention.
Figure 2:
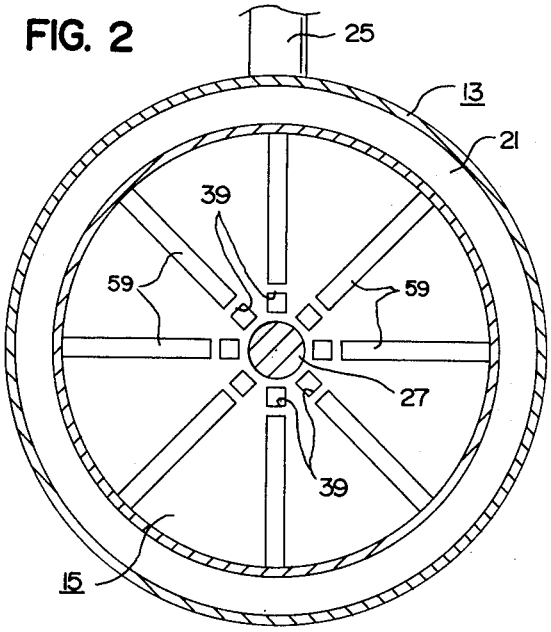
FIG. 2 is a sectional view of the centrifugal pump means of the present invention as taken on line II-II of FIG. 1.
Figure 3:
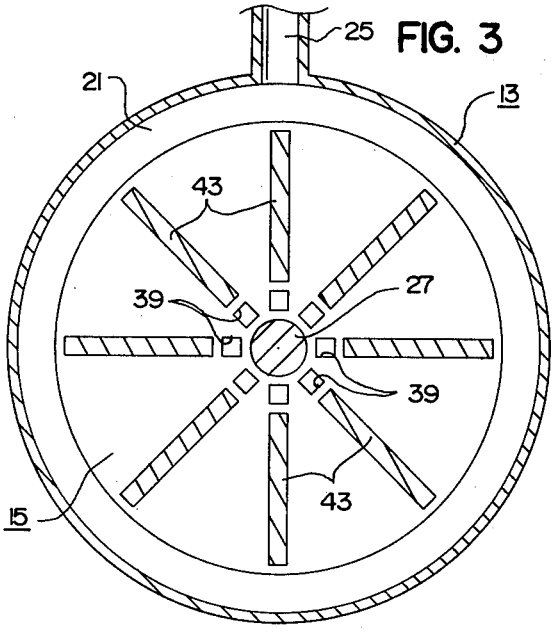
FIG. 3 is a sectional view of the centrifugal pump means of the present invention as taken on line III-III of FIG. 1.

The centrifugal pump means 11 of the present invention is for use in pumping liquid such as water from a first location to a second location. In general, the centrifugal means 11 includes a housing means 13, an impeller means 15, a drive means 17 and a seal means.

The housing means 13 includes a hollow interior 21, a centrally located inlet means for allowing liguid to enter the interior 21, and peripherally located outlet means for allowing liquid to exit the interior 21. The inlet means includes at least one and preferably two inlet ports 23 located adjacent the center of the housing means 13. The outlet means includes at least one outlet portion 25 located on the periphery of the housing means 13. It should be noted that the inlet ports 23 are connected to a liquid supply source such as a water reservoir by pipes or the like in a manner well known to those skilled in the art.

The drive means 17 preferably includes a drive shaft 27 and a motor means 29. The drive shaft 27 preferably extends into the center of the interior 21 of the housing means 13 and is rotatably mounted to the housing means 13 by liquid-tight bearing 31 or the like in a manner well known to those skilled in the art. The motor means 29 is adapted to selectively rotate the drive shaft 27 and may be of any type well known to those skilled in the art.

The impeller means 15 is positioned within the interior 21 of the housing means 13 and is fixedly attached to the drive shaft 27 for rotation therewith to selectively draw liquid into the interior 21 of the housing means 13 through the inlet ports 23 thereof and forcing liquid to the periphery of the interior 21 of the housing means 13 and out the outlet port 25 thereof. The impeller means 15 preferably includes a first plate member 33 and a second plate member 35 fixedly attached to the drive shaft 27. The first and second plate members 33, 35 are spaced apart from one another on the drive shaft 27 to form a chamberlike portion 37 therebetween. The impeller means 15 includes centrally located inlet means for allowing fluid to enter the chamber-like portion 37 and includes peripherally located outlet means for allowing water to exit the chamber-like portion 37. The inlet means may consist of a plurality of inlet ports 39 provided in the first and second plate members 33, 35 located adjacent the drive shaft 27. The outlet means preferably consists of the space 41 between the peripheral edges of the inner walls of the first and second plate members 33, 35. The impeller means 15 includes a plurality of vane members 43 positioned between the first and second plate members 33, 35 and fixedly attached to the drive shaft 27 for creating a centrifugal force when the drive shaft 27 rotates to cause fluid to enter the chamber-like portion 37 through the inlet ports 39 of the impeller means 15 and to exit the chamber-like portion 37 through the space 41. It should be noted that the plurality of vane members 43 may be fixedly attached to the drive shaft 27 indirectly by being fixedly attached to the inner walls of the first and second plate members 33, 35 which are, in turn, fixedly attached to the drive shaft 27.

The seal means is adapted to prevent the liquid being forced to the periphery of the interior 21 of the housing means 13 from passing back to the center of the interior 21 of the housing means 13. More specifically, the seal means is adapted to prevent the liquid exiting the chamber-like portion 37 of the impeller means 15 through the space 41 from reentering the chamber-like portion 37 of the impeller means 15 through the inlet ports 39. That is, the seal means prevents the liquid exiting the chamber-like portion 37 of the impeller means 15 through the space 41 from flowing back to the center of the interior of the housing means 13 once it has been forced to the periphery of the interior 21 of the housing means 13 by the impeller means 15. The seal means preferably includes a first disklike member 45 fixedly attached to the interior 21 of the housing means 13 substantially aligned with the first plate member 33 of the impeller means 15. The first disklike member 45 is spaced away from the first plate member 33 of the impeller means 15 to form a chamber-like portion 47 therebetween. In addition, the seal means preferably includes a second disklike member 49 fixedly attached to the interior 21 of the housing means 13 substantially aligned with the second plate member 35 of the impeller means 15. The second disklike member 49 is spaced away from the second plate member 35 of the impeller means 15 to form a chamber-like portion 51 therebetween. Each of the first and second disklike members 45, 49 include a centrally located opening 53 for allowing fluid to enter the respective chamber-like portions 47, 51 from the inlet ports 23 of the housing means 13. It should be noted that the openings 53 are preferably sufficiently larger than the drive shaft 27 to allow the drive shaft 27 to pass through the openings 53 and to allow the fluid to freely pass through the openings 53. The seal means preferably includes a first annular flange member 55 fixedly attached to the periphery of the first plate member 33 of the impeller means 15 and extending over and spaced above the periphery of the first disklike member 45. The seal means 19 preferably includes a second annular flange 57 attached to the periphery of the second plate member 35 of the impeller means 15 and extending over and spaced above the periphery of the second disklike member 49. The seal means preferably includes a plurality of vane members 59 positioned in the chamber-like portion 47 and fixedly attached to the outer wall of the first plate member 33 of the impeller means for rotation therewith to force the liquid in the chamber-like portion 47 to the periphery of the chamber-like portion 47. Likewise, the seal means preferably includes a plurality of vane members 61 positioned in the chamber-like portion 51 and fixedly attached to the second plate member 35 of the impeller means 15 for rotation therewith to force the liquid in the chamber-like portion 51 to the periphery of the chamber-like portion 51.

The operation of the centrifugal pump means 11 is as follows: First, the motor 29 is activated to cause the drive shaft 27 and impeller means 15 to rotate. As the impeller means 15 rotates, fluid is drawn into the interior 21 of the housing means 13 through the inlet ports 23 in the housing means (see arrows 63) by the centrifugal force created by the rotation of the impeller means 15. The fluid then passes through the openings 53 in the first and second disklike member 45, 49 into the chamber-like portions 47, 51 (see arrows 65). From the chamber-like portions 47, 51 the majority of the fluid is drawn through the plurality of inlet ports 39 of the impeller means 15 into the chamber-like portion 37 of the impeller means 15 (see arrows 67) where it is forced to the periphery of the interior 21 of the housing means through the space 41 between the peripheral edges of the inner walls of the first and second plate members 33, 35 of the impeller means 15 (see arrows 69). A portion of the fluid in the chamber-like portions 47, 51 is forced outwardly from the center of the interior 21 of the housing means 13 by the plurality of vane members 59, 61 of the seal means (see arrows 71). The majority of the fluid being forced to the periphery of the interior 21 of the housing means 13 by the impeller means 15 is forced through the outlet port 25 in the housing means 13 (see arrows 73). A portion of the fluid being forced to the periphery of the interior 21 of the housing means 13 by the impeller means 15 bypasses the outlet portion 25 in the housing means 13 (see arrows 75). The fluid forced outwardly from the center of the interior 21 of the housing means 13 by the plurality of vane members 59, 61 of the seal means (see arrows 71) and the fluid forced to the periphery of the interior 21 of the housing means 13 by the impeller means 15 that bypasses the outlet port 21 in the housing means 13 (see arrows 75) tend to form an equilibrium with one another to prevent "short circuiting" of the fluid being forced to the periphery of the interior 21 of the housing means 13 by the impeller means 15 back to the center of the interior 21 of the housing means 13.

As thus constructed and operated, the present invention provides a centrifugal pump means which prevents "short circuiting" of the fluid being pumped back to the center of the pump housing thereby preventing the reduction of the efficiency of the pump means and which allows the use of a lighter design pump housing with a larger diameter impeller means thereby increasing the volume of the pump means without increasing the construction cost thereof.

Although the invention has been described and illustrated with respect to a preferred embodiment thereof, it is not to be so limited since changes and modifications may be made therein which are within the full intended scope of the invention.

I claim:

1. Centrifugal pump means for pumping liquid, said pump means comprising:

a. housing means including a hollow interior, including centrally located inlet means for allowing liquid to enter said interior, and including peripherally located outlet means for allowing liquid to exit said housing means;

b. drive means including a drive shaft extending into said interior of said housing means centrally thereof and including a motor means for selectively rotating said drive shaft;

c. impeller means positioned within said interior of said housing means, said impeller means including first and second plate members fixedly attached to said drive shaft, said first and second plate members being spaced apart from one another to form a chamber-like portion therebetween, said impeller means including centrally located inlet means for allowing liquid to enter said chamber-like portion and including peripherally located outlet means for allowing liquid to exit said chamber-like portion, said impeller means including a plurality of vane members positioned between said first and second plate members and fixedly attached to said drive shaft for creating a centrifugal force when said drive shaft rotates to cause liquid to enter said chamber-like portion through said inlet means of said impeller means and to exit said chamber-like portion through said outlet means of said impeller means; and d. seal means for preventing the liquid exiting said chamber-like portion of said impeller means through said outlet means of said impeller means from reentering said chamber-like portion of said impeller means through said inlet means of said impeller means, said seal means including first and second disklike members fixedly attached to said interior of said housing means substantially aligned with said first and second plate members of said impeller means, said first disklike member being spaced away from said first plate member of said impeller means to form a chamber-like portion therebetween, said second disklike member being spaced away from said second plate member of said impeller means to form a chamber-like portion therebetween, each of said first and second disklike members including a centrally located opening for allowing liquid to enter said respective chamber-like portions from said inlet means of said housing means, said seal means including a first annular flange member attached to the periphery of said first plate member of said impeller means and extending over and spaced above the periphery of said first disklike member, said seal means including a second annular flange member attached to the periphery of said second plate member of said impeller means and extending over and spaced above the periphery of said second disklike member, said seal means including a plurality of vane members positioned in each of said chamber-like portions thereof and fixedly attached to said first and second plate member of said impeller means for rotation therewith to force liquid in said first and second chamber-like portion to exit said first and second chamber-like portion through the space between said first and second disklike member and said first and second annular flange member respectively thereby preventing the liquid exiting said chamber-like portion of said impeller means from entering said first and second chamber-like portions of said seal means.

* * * * *